United States Patent [19]

Blum

[11] Patent Number: 4,624,520

[45] Date of Patent: Nov. 25, 1986

[54] COAXIAL CABLE CLAMP

[75] Inventor: Kenneth P. Blum, Middlesex County, N.J.

[73] Assignee: Thomas & Betts Corporation, Raritan, N.J.

[21] Appl. No.: 720,647

[22] Filed: Apr. 8, 1985

[51] Int. Cl.[4] ..... H01R 11/20

[52] U.S. Cl. ..... 339/97 R; 339/244 R; 339/263 R; 339/268 R

[58] Field of Search ..... 339/14 R, 14 L, 97 R, 339/97 P, 98, 99, 100, 177 R, 177 E, 243, 244 R, 263 R, 263 L, 265 R, 268 R, 272 R

[56] References Cited

U.S. PATENT DOCUMENTS

| | | | |
|---|---|---|---|
| 2,322,702 | 6/1943 | Peterson | 174/6 |
| 2,642,474 | 6/1953 | Bowar | 339/107 |
| 2,805,399 | 9/1957 | Leeper | 333/6 |
| 2,843,827 | 7/1958 | Blonder | 339/97 R |
| 2,963,676 | 12/1960 | Sneesby et al. | 339/23 |
| 3,187,290 | 6/1965 | Winders | 339/23 |
| 3,295,076 | 12/1966 | Kraus | 333/97 |
| 3,332,052 | 7/1967 | Rusinyak | 339/177 |
| 3,372,361 | 3/1968 | Wengen | 339/97 R |
| 3,585,571 | 6/1971 | Davis | 339/97 P |
| 3,594,703 | 7/1971 | Holtzapple | 339/97 R |
| 4,365,859 | 12/1982 | Hunter et al. | 339/97 |
| 4,469,391 | 9/1984 | Rich | 339/97 |
| 4,502,749 | 3/1985 | Forney, Jr. et al. | 339/177 |

*Primary Examiner*—Gil Weidenfeld
*Assistant Examiner*—Paula Austin
*Attorney, Agent, or Firm*—Robert M. Rodrick; Salvatore J. Abbruzzese

[57] ABSTRACT

A connector for impedance matched, low capacitance connection to coaxial cable is disclosed. The connector includes a conductive housing which supports in electrical isolation an insulation displacing electrical contact. A clamping element forces the center conductor of the coaxial cable down onto the insulation displacing portion contact for electrical termination. An assembly nut supports the drain wire of the coaxial cable, in electrical engagement therewith, to place the connector housing in electrical continuity with the drain wire of the cable.

19 Claims, 6 Drawing Figures

FIG. 3
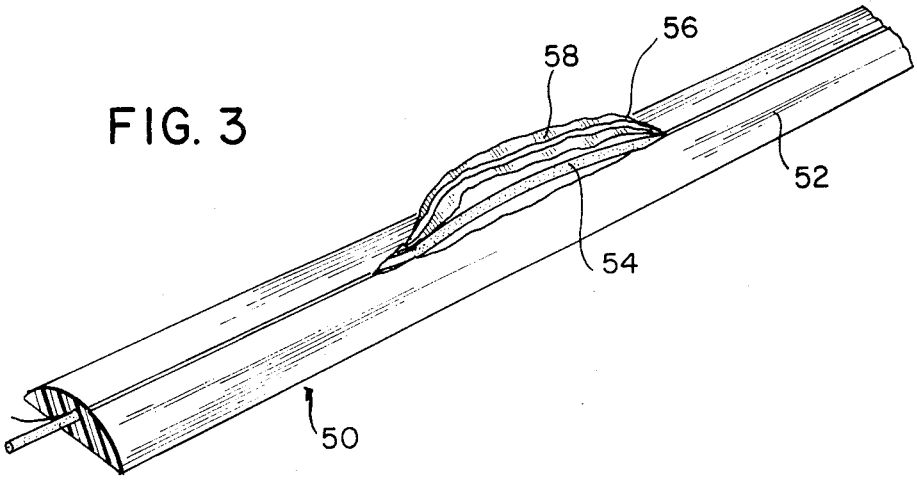
FIG. 5
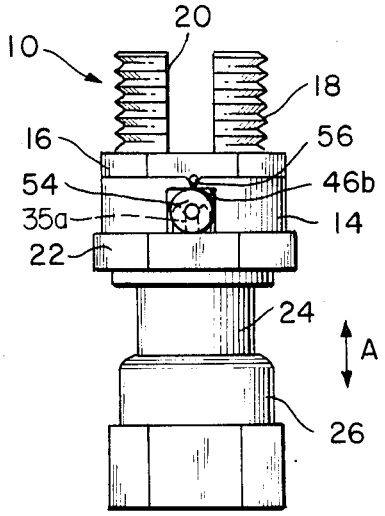
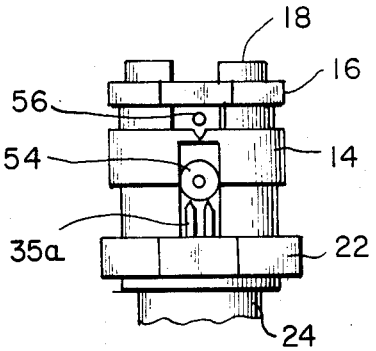
FIG. 4

COAXIAL CABLE CLAMP

FIELD OF THE INVENTION

This invention relates generally to an electrical termination device for coaxial cable and more particularly pertains to an impedance-matched low capacitance connector for coaxial cable which provides data transmission to computer terminal or similar devices.

BACKGROUND OF THE INVENTION

With the advent of the intra-office digital communication link, intended to serve a plurality of computer terminals, need has arisen for an effective system of interconnecting each of the computer terminals to provide data transmission therebetween. Example of systems where data communication is established between several computer terminals in a single office or adjoining offices is local area networks (LANS) especially the Ethernet and Thinnet system of the Xerox Corporation.

The cable used to serve computer terminals in a LAN system is typically a coaxial cable having an insulated center conductor, a non-insulated drain wire, an electrically conductive shield and an outer insulated jacket. Various connector designs have been used to make connections to this type of coaxial cable. One series of connectors requires stripping of the outer insulative jacket separating the shield, the drain wire and the insulative conductor and further stripping of the insulative conductor to make effective electrical connection. Other approaches include insulation displacing techniques which will make connection to the cable without necessity for stripping the outer insulative jacket.

While insulation displacing techniques are desirable, in that they alleviate the need for time consuming manual cable stripping, it is difficult to pierce through the outer insulation and make contact with the center conductor without also engaging the outer conductive shield. For effective data transmission it is desirable to electrically isolate the conductive shield from the center conductor. An example of a coaxial tap connector having an insulation displacing drive pin is shown in U.S. Pat. No. 4,365,859, issued Dec. 28, 1982. However, the drive pin contacts both the center conductor and the conductive shield.

An alternative approach to the drive pin type insulation displacing coaxial tap, shown in the '859 patent is a coaxial cable connector shown in U.S. Pat. No. 4,469,391, issued Sept. 4, 1984, and assigned to the assignee of the present invention. This connector includes an insulation displacing fork type contact member used to electrically engage the center conductor of the coaxial cable. This device also accommodates in electrical isolation from the center conductor, the drain wire and conductive shield of the coaxial cable. This connector is especially useful for connecting flat coaxial cable of the type shown in U.S. Pat. No. 4,404,425, issued Sept. 13, 1983, and also assigned to assignee of the present invention. While this connector effectively connects coaxial cable of this type, an installing tool is required to insert the center conductor into insulation displacing engagement with the electrical contact. Further, once terminated, the center conductor is not seated against the insulation displacing portions of the contact. Heavy vibration could jar loose the conductor from its insulation displacing connection with the contact. Therefore, it is desirable to provide an insulating displacing coaxial tap which requires no installing tools and which effectively secures the center conductor against the insulation displacing portions of the contact.

SUMMARY OF THE INVENTION

The present invention has as its object the provision of simplified connection of coaxial cable to an electrical connector.

It is a more particular object of the invention to provide an impedance matched cable termination for shielded coaxial cable which requires no special tools and effectively maintains electrical connection throughout its useful life.

In attaining the forgoing and other objects, the present invention provides an electrical connector for coaxial cable having an elongate conductive body which accommodates both an insulative conductor and a drain wire of the coaxial cable. An insulation displacing electrical contact is supported in the body for electrical engagement with the insulative conductor. A clamping element is removably supported on the body for clamping the insulated center conductor between the insulation displacing portions of the electrical contact and the clamping body, securing means is included for engaging the clamping element and moving the clamping element to force the insulated center conductor into insulation displacing electrical engagement with the electrical contact. The drain wire may be inserted between the clamping element and the securing means to provide electrical continuity to the connector body and thereby an impedance matched shielded connection.

BRIEF DESCRIPTION OF THE DRAWINGS

FIG. 3 is a perspective view of a type of cable to be tapped by the connector of FIG. 1, the cable being shown with its insulated center conductor, shield and drain wire partially withdrawn from its protective casing.

FIG. 4 is a front electrical showing of a portion of the connector of FIG. 1, prior to full assembly including the cable center conductor and drain wire therein.

FIG. 5 is a front elevational showing of the assembled connector of FIG. 1, including the cable center conductor and drain wire therein.

Figure 1:
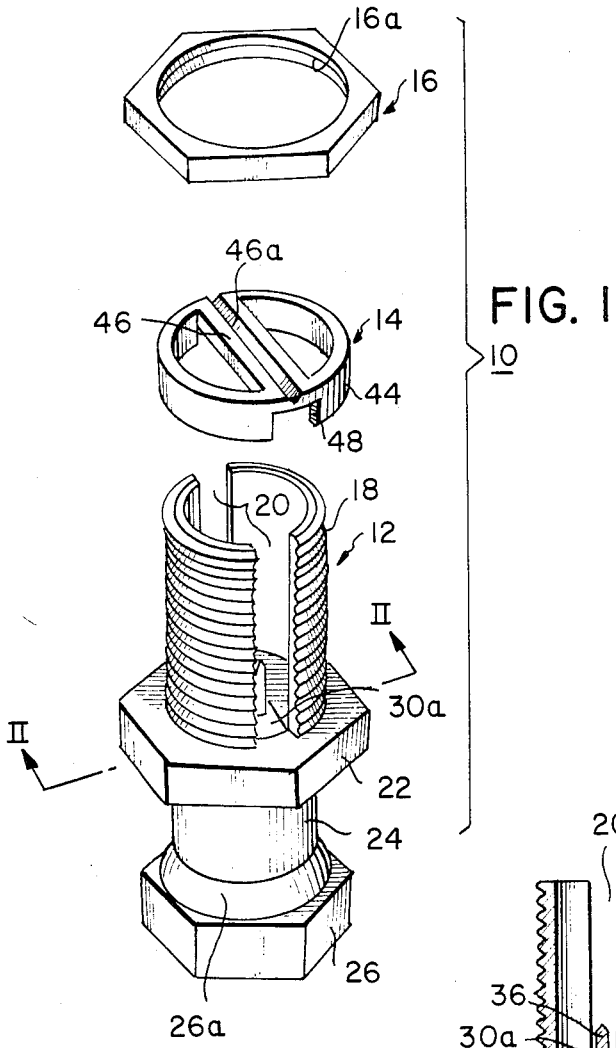
FIG. 1 is an exploded perspective view of the component parts of coaxial cable tap of the present invention.
Figure 2:
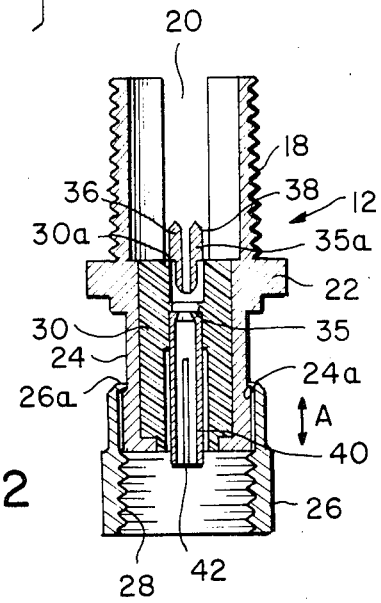
FIG. 2 is a vertical section of the body portion of coaxial cable tap of FIG. 1., taken along the lines II—II.

DETAILED DESCRIPTION OF THE PREFERRED EMBODIMENT:

Referring to FIGS. 1 and 2, connector 10 includes housing 12, clamping member 14, and assembly nut 16, all constructed of electrically conductive material, such as beryllium copper.

Housing 12 is an elongate generally hollow cylindrical member, having at one end a cable engagement portion 18, and at the other end a connector engagement portion 24. Centrally located between cable engagement portion 18 and connector engament portion 24 is a hexagonally shaped central shoulder 22 which when used with an appropriate tool facilitate installation of connector 10.

Cable engagement portion 18, includes a pair of diametrically opposed upwardly opening vertical slots 20, which provides a cable entry opening, as will be described in greater detail hereinbelow. Slots 20 extend from the base of connector engagement portion 18 to the distal extend thereof. Cable engagement portion 18 is exterally screw threaded for mating accommodation with further connector parts as will be described hereinbelow.

Connector engagement portion 24 accommodates, at its lower distal end, a connection sleeve 26. Connection sleeve 26 is of conventional construction and rotatably supported on connector engagement portion 24 for external connection. An outwardly depending shoulder 24a of connector engaging 24 cooperates with an inwardly directed flange 26a of connector sleeve 26 to provide for the rotative securement of connector sleeve 26 on connector engaging portion 24. Further, connection sleeve 26 is moveable vertically in the direction of arrow A along connector engaging portion 24. Connection sleeve 26 may be internally screw threaded for cooperative connection with a externally threaded coaxial termination of a tranceiver or other electrical device.

Shown in detail in FIG. 2, an insulated support member 30 is supported in the hollow central portion of connector engaging portion 24. Insulative support member 30 may be formed of any suitable insulative material, such as plastic and more specifically polypropelene. Insulative support member 30 serves to support and electrically isolate, insulation displacing contact 35, centrally accommodated in housing 12 of connector 10. Contact element 35 is formed of suitably conductive material such as beryllium copper. Contact element 35 is an elongate member having an upper insulation displacing end portion 35a, including a pair of insulation displacing teeth 36 and 38. Opposite contact element end portion 40 is of the female coaxial connection type and includes a central channel 42 for accommodating a stinger or pin of a male mating coaxial connector (not shown). It, however, can be appreciated that end portion 40 can be of any conventional construction. As shown in FIGS. 1 and 2, the insulation displacing portions 36 and 38 of contact element 35 extend above the upper surface 30a of insulated support member 30 and are aligned with each of the vertical slots 20.

Referring now to FIG. 1, the remaining elements of connector 10 are shown. The clamping member 14 is a washer type element having an annular body 44. A diametrically extending cross member 46 spans body 44 and is dimensioned to be accomodated in the vertical slots 20 of cable engagement portion 18 of connector 10. Adjacent each diametrical extent of cross member 46 are a pair of downwardly opening conductor accommodating recesses 48, which are also alignable with slots 20. Diametrical cross member 46 further includes on the upper surface thereof an elongate V-shaped channel 46a, the use and function of which will be described in greater detail hereinbelow.

The final component of connector 10 is the assembly nut 16, which is internally screw threaded at 16a for screw accommodation on cable engagement portion 18. Assembly nut 16 securely supports clamping member 14 on cable engagement portion 18.

Turning now to FIGS. 2 and 3, a type of cable 50 is shown which may be tapped into or end terminated with connector 10. Cable 50, which is more fully described in the above mentioned commonly assigned U.S. Pat. No. 4,404,425, includes a resilient protective casing 52 of electrically insulative material and a coaxial cable assembly therein, comprising an insulated conductor 54, a drain wire 56, an electrically conductive outer sheath 58, which surrounds insulated conductor 54 and drain wire 56. In the present illustrative embodiment a metal foil type conductive sheath is shown, however, the sheath may also be formed of conventional braided wire. The drain wire 56 is in intimate contact with sheath 58 and therefore at the same electrical potential. The drain wire 56 and sheath 58 are typically placed at ground potential to serve as an effective electrical shield for cable 50. The cable 50 of FIG. 3, is shown prepared for tapping into a central portion thereof. The insulated conductor 54, drain wire 56 and electrically conductive sheath 58 have been removed from a central portion of protective casing 52.

Figure 6:
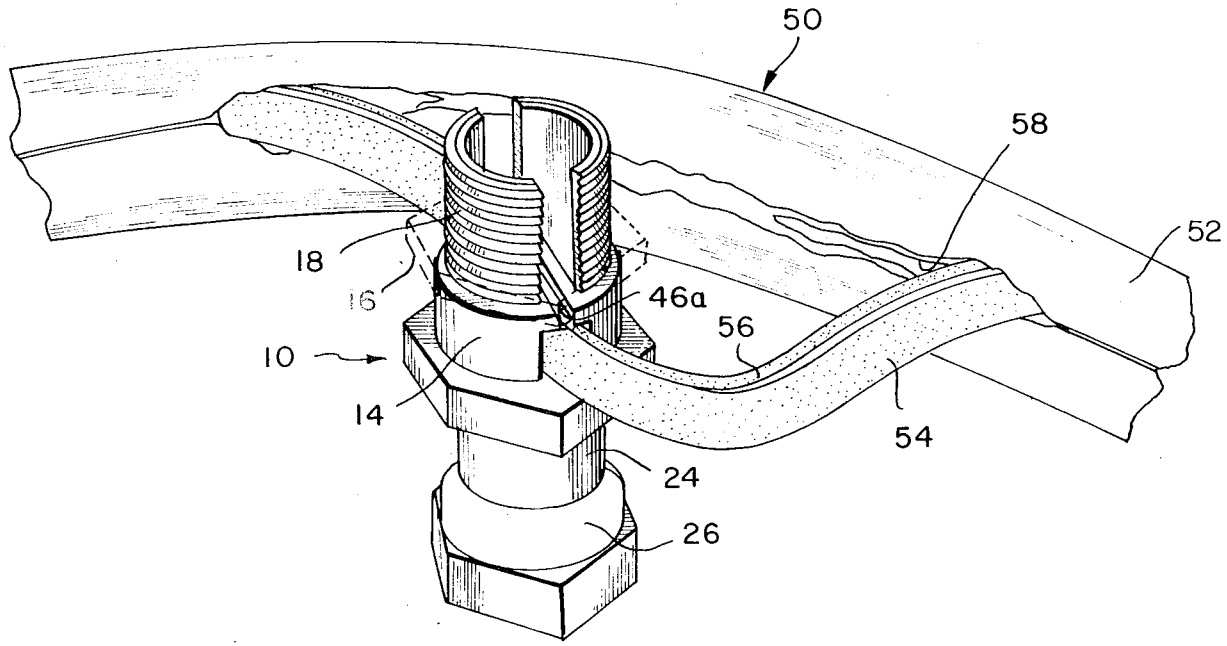
FIG. 6 shows in perspective view the assembled cable connector of FIG. 1 tapping a cable shown in FIG. 3.

Referring now to FIGS. 4, 5 and 6, the termination of cable 50 with connector 10 may now be described. After having prepared the cable, as shown in FIG. 3, the insulated conductor 54 may be inserted into cable engagement portion 18 between vertical slots 20. The cable is inserted into vertical slots 20 until a transverse extent of the cable abuts the insulation displacing portion 35a. of contact element 35. Clamping member 14 is then brought down over insulated conductor 54 with the cross member 46 being accomodated between vertical slots 20. Downwardly opening recesses 48, adjacent slots 20, accommodate insulated conductor 54. Drain wire 56 is then inserted into cable engagement portion 18 through vertical slots 20. The drain wire is accommodated in the V-shaped channel 46a Assembly nut 16 is then screw threaded onto upper end of cable engagement portion 18. With the connector 10 assembled, as shown in FIG. 4, the assembly nut 16 may then be either hand tightened or tightened by use of a suitable tool, such as a wrench, until it bears against the drain wire 56 and forces the drain wire into intimate contact with clamping member 14. The drain wire being positionally confined by the V-shaped recess 46a and will not twist or turn upon rotation of assembly nut 16. Further tightening of assembly nut 16 forces it into contact with clamping member 14 which in turn is forced downward onto insulated conductor 54 being accommodated in downwardly opening recesses 48. Still further movement of assembly nut 16 progressively urges clamping member 14 and insulated conductor 54 downward whereupon the insulated conductor is forced onto insulation displacing teeth 36 and 38 of contact 35. Insulated conductor 54 will then be electrically connected to contact element 35 in conventional insulation displacing fashion. The drain wire 56 being sandwiched between assembly nut 16 and clamping member 14 will be in electrical connection therewith and also in electrical connection with conductive housing 12. The connector 10, as shown in FIG. 5, is now at the same electrical potential as drain wire 56, which is typically placed at ground potential for shielding purposes. Thus, connector 10 will serve as an electrical shield for the coaxial cable tap. Contact element 35, being supported in insulative support member 30, is electrically isolated from the remainder of the connector and therefore connects directly to insulative conductor 54 without interfering with or coupling to the electrical shield.

Shown assembled in FIG. 5, connector 10 also supports insulated conductor 54 in fixed position in electrical connection with contact element 35. Clamping member 14 is seated against shoulder 22 and held in positional confinement by assembly nut 16. Conductor 54, electrically terminated on insulation display portion 35*a*, is prevented from becoming dislodged from its position therein as the clamping member 14 bears directly on insulated conductor 54. An undersurface 46*b* of cross member 46 contacts the insulation of insulated conductor 54 preventing upward withdrawal thereof. Recesses 48 accommodate a transverse extention of insulated conductor 54. Thus, the insulated conductor 54 will extend through each recess 48 and vertical slot 20 of drawing 12, and be vertically positionally confined therein. As long as assembly nut 16 is securely fastened to threaded portion 18, insulated conductor 54 will not vibrate loose from its electrical connection with contact 35.

As shown in FIG. 6, the assembled connector 10 mechanically and electrically supports both insulated conductor 54 and drain wire 56. It is further contemplated that a portion of the shield 58 may be wedged between clamping member 14 and assembly nut 16 to further provide electrical shield connection with the connector housing 12. However, as the drain wire is in intimate contact with the shield along the length of cable 50, connection of the shield 58 is not essential for continuous shielding.

It is further contemplated that an insulative connector housing (not shown) may be used to enclose both connector 10 and a longitudinal extent of cable 50 adjacent connector 10. Connector sleeve 26 would remain external of the housing in order to provide for coupling of connection 10 to a transceiver, another coaxially terminated cable or electronic device.

Various changes to the foregoing describe and shown structures would now be evident to those skilled in the art. Accordingly, the particularly disclosed embodiment is only attended in a illustrative purpose. The scope of the invention is set forth in the following claims.

I claim:

1. A connector for electrical cable having an elongate insulated conductor and a drain wire conductor, said connector comprising:

an elongate conductive housing for accommodating said insulated conductor and said drain wire;

an electrical contact supported in and electrically isolated from said housing, said contact having a first insulation displacing end portion for electrical and mechanical engagement with said insulated conductor and a second opposed end portion extending exteriorly of said housing;

a conductive clamping element movably supported on said housing for contacting said insulated conductor and movable to urge said insulated conductor into insulation displacing connection with said first end portion of said contact, said clamping element including means for mechanically and electrically supporting said drain wire; and securement means for providing said clamping element movement; said urging means further urging said drain wire into said mechanical and electrical connection with said clamping element.

2. A connector of claim 1 wherein said housing includes an elongate channel for receipt of a transverse extent of said insulative conductor.

3. A connector of claim 2 wherein clamping element includes a clamping portion insertable into said channel of said housing, said clamping portion having a first surface engageable with said insulated conductor.

4. A connector of claim 3 wherein said supporting means includes a second surface of said clamping portion opposite said first surface for accommodating said drain wire.

5. A connector of claim 4 wherein said clamping portion second surface includes a elongate slot therein for accommodating said drain wire.

6. A connector of claim 1 wherein said housing includes an externally threaded end portion and wherein said securement means includes an interiorly threaded nut for mating connection with said housing end portion.

7. A connector of claim 6 wherein said threaded nut is formed of electrically conductive material.

8. A connector of claim 6 further comprising coupling means rotatably secured to said elongate housing at the end opposite said threaded end for providing external connection.

9. A connector of claim 8 wherein said coupling means is movable along a longitudinal portion of said housing.

10. A tap for electrical cable having an insulated coductor and a non-insulated conductor, said tap comprising:

an elongate conductive body having a first cable accommodated and a second connection end;

an electrical contact supported in said housing intermediate said two ends, said contact having an insulation displacing portion for electrically engaging said insulated conductor and a terminal portion extending exteriorly said second end of said housing an urging member movably supported on said body first end said urging member having a portion thereof engagable with said insulative conductor to urge said insulate conductor into insulation displacing electrical contact with said insulation displacing portion of said contact upon movement thereof; and conductive securement means movably coupled to said body first end and electrically engageable with said non-insulated conductor, said securement means movably engageable with said urging member to import said movement to said urging member.

11. A tap of claim 10 wherein said body first end is generally a hollow cylindrical member having a pair of diametrically opposed traverse slots through the wall thereof for accommodating said cable.

12. A tap of claim 11 wherein said cylindrical first end of said body is externally screw threaded and said conductive securement means is an interiorly threaded angular nut for screw coupling to said cylindrical first end of said body.

13. A tap of claim 11 wherein said urging member is annular and dimensional to surround said cylindrical first end of said body, said annular urging member including a diametrical cross bar insertable in said slots of said body first end.

14. A tap of claim 13 wherin said diametrical cross bar includes a first surface for engagement with said insulated conductor and a second opposed surface including means for supporting said non-insulated conductor.

15. A tap of claim 14 wherein said annular urging member is electrically conductive and said supporting means include an elongate slot for nesting receipt of said non-insulated conductor therein.

16. A connector for electrical co-axial cable having an insulated conductor and a non-insulated drain wire, said connector comprising:

a housing having a channel for receipt of said insulative conductor and said drain wire;

an electrical contact having an insulation displacing portion for electrical engagement with said insulated conductor and a terminal portion;

a clamping member removably supported on said housing, said clamping member having a portion thereof for positioning adjacent said insulation displacing portion of electrical contact for positionally confining said insulated conductor in engagement with said insulation displacing portion thereof, said clamping member further includes a support portion thereof for supporting said drain wire; and securement means for securing said clamping member against said insulation displacing portion of said electrical contact and positionally confing said drain wire against said support portion of said clamping member.

17. A connector of claim 16 wherein said housing and said securement means are electrically conductive and said housing is electrically coupled to said drain wire.

18. A connector of claim 16 where said housing and said clamping member are electrically conductive and said housing is electrically coupled to said drain wire.

19. A connector of claim 16 wherein said clamping means is movably supported on said housing for movement into engagement with said insulated conductor to urge said insulated conductor into insulation displacing electrical connection with said insulation displacing portion of said electrical contact.

* * * * *

UNITED STATES PATENT AND TRADEMARK OFFICE

CERTIFICATE OF CORRECTION

PATENT NO. : 4,624,520

DATED : November 25, 1986

INVENTOR(S) : Kenneth P. Blum

It is certified that error appears in the above-identified patent and that said Letters Patent is hereby corrected as shown below:

In Claim 1, Column 5, line 59, change"urging" to --securement--. (1st occurrence)

In Claim 4, Column 6, line 1, change "wherein said supporting means includes" to --including--.

In Claim 10, Column 6, line 23, change "coductor" to --conductor--.

In Claim 10, Column 6, line 26, change "accommodated" to --accommodating end--.

In Claim 10, Column 6, line 27 and line 31, change "housing" to --body--.

In Claim 10, Column 6, line 35, change "insulative" to --insulated--.

In Claim 10, Column 6, line 36, change "insulate" to --insulated--.

In Claim 10, Column 6, line 44, change "import" to --impart--.

Signed and Sealed this

Seventeenth Day of May, 1988

*Attest:*

DONALD J. QUIGG

*Attesting Officer*

*Commissioner of Patents and Trademarks*